US010933298B2

(12) United States Patent
Zhang et al.

(10) Patent No.: US 10,933,298 B2
(45) Date of Patent: Mar. 2, 2021

(54) ANTI-REVERSE ROTATION DEVICE OF POWER-DRIVEN SHOE DEVICE

(71) Applicant: Nimbus Robotics, Inc., Pittsburgh, PA (US)

(72) Inventors: Jiancheng Zhang, JiangBei NingBo (CN); Bojie Xu, JiangBei NingBo (CN); Jianjun Li, JiangBei NingBo (CN); Dongliang Song, JiangBei NingBo (CN)

(73) Assignee: Nimbus Robotics, Inc., Pittsburgh, PA (US)

( * ) Notice: Subject to any disclaimer, the term of this patent is extended or adjusted under 35 U.S.C. 154(b) by 0 days.

(21) Appl. No.: 16/346,860

(22) PCT Filed: Aug. 3, 2017

(86) PCT No.: PCT/CN2017/000501
§ 371 (c)(1),
(2) Date: May 1, 2019

(87) PCT Pub. No.: WO2018/082194
PCT Pub. Date: May 11, 2018

(65) Prior Publication Data

US 2020/0061444 A1 Feb. 27, 2020

(30) Foreign Application Priority Data

Nov. 1, 2016 (CN) ..... 201610937116.7

(51) Int. Cl.
*A63C 17/12* (2006.01)
*A63C 17/00* (2006.01)

(52) U.S. Cl.
CPC ..... *A63C 17/12* (2013.01); *A63C 17/0006* (2013.01)

(58) Field of Classification Search
CPC ..... A63C 17/12
See application file for complete search history.

(56) References Cited

U.S. PATENT DOCUMENTS 833,100 A * 10/1906 Wells ..... A63C 17/12 280/11.115
1,672,700 A * 6/1928 Vass ..... A63C 17/02 280/11.31

(Continued)

FOREIGN PATENT DOCUMENTS

CN 2759524 Y 2/2006
CN 201423154 Y 3/2010

(Continued)

OTHER PUBLICATIONS

International Search Report and Written Opinion for PCT/CN2017/000501 dated Nov. 3, 2017.

(Continued)

*Primary Examiner* — Erez Gurari
(74) *Attorney, Agent, or Firm* — Troutman Pepper Hamilton Sanders LLP

(57) ABSTRACT

Disclosed is an anti-reverse rotation device of a power-driven shoe device, the power-driven shoe device comprising a shoe sole (1), wherein a group of front wheels (2) and a group of rear wheels (3) are arranged on a lower side surface of the shoe sole (1); and the front wheels (2) are connected to an anti-reverse rotation mechanism for preventing the front wheels (2) from rotating in reverse. The anti-reverse rotation mechanism can prevent the front wheels (2) from rotating in reverse, and as such, when the front wheels (2) are independently in contact with the ground and a certain included angle is formed between a shoe body and the ground, the situation of the front wheels (2) applying a certain pressure to the ground and the front wheels (2) rotating in reverse, such that a lifted foot moves (Continued)

backwards, thereby causing a person to fall down, is avoided, and walking safety is improved.

3 Claims, 1 Drawing Sheet

(56) References Cited

U.S. PATENT DOCUMENTS 1,801,205 A 4/1931 Mirick
2,857,008 A * 10/1958 Pirrello ..... A63C 17/12 180/181
3,392,986 A * 7/1968 Ryan ..... A63C 17/12 280/11.115
4,334,690 A * 6/1982 Klamer ..... A63C 17/1436 188/82.7
4,417,737 A * 11/1983 Suroff ..... A63C 17/12 280/11.115
4,553,767 A * 11/1985 Robjent ..... A63C 17/1454 188/82.3
RE32,346 E * 2/1987 Klamer ..... A63C 17/1454 188/82.7
4,932,676 A * 6/1990 Klamer ..... A63C 17/1454 188/82.3
5,056,802 A * 10/1991 Piotrowski ..... A63C 17/12 280/11.115
5,236,058 A * 8/1993 Yamet ..... A63C 17/12 180/181
5,400,484 A * 3/1995 Gay ..... A44B 11/20 24/593.11
5,730,241 A * 3/1998 Shyr ..... A63C 17/10 180/181
5,797,466 A * 8/1998 Gendle ..... A63C 17/265 180/181
6,059,062 A * 5/2000 Staelin ..... A63C 17/12 180/181
6,322,088 B1 * 11/2001 Klamer ..... A63C 17/02 280/11.27
6,497,421 B1 * 12/2002 Edgerley ..... A43B 3/26 280/11.19
6,517,091 B1 * 2/2003 Fisher ..... A63C 1/26 280/11.26
6,645,126 B1 11/2003 Martin et al.
7,163,210 B1 * 1/2007 Rehkemper ..... A63C 17/12 280/11.221
7,204,330 B1 * 4/2007 Lauren ..... A63C 17/12 180/181
9,027,690 B2 * 5/2015 Chavand ..... A63C 17/12 180/181
9,295,302 B1 3/2016 Reed et al.
9,925,453 B1 * 3/2018 Tuli ..... A43B 3/0005
10,456,698 B2 * 10/2019 Chen ..... A63H 19/10
2001/0022433 A1 * 9/2001 Chang ..... A43B 5/1633 280/11.19
2003/0047893 A1 * 3/2003 Pahis ..... A63C 17/12 280/11.115
2003/0141124 A1 * 7/2003 Mullet ..... A63C 17/12 180/181
2004/0239056 A1 * 12/2004 Cho ..... A63C 17/008 280/7.1
2005/0046139 A1 * 3/2005 Guan ..... A63C 17/12 280/221
2006/0027409 A1 * 2/2006 Adams ..... A63C 17/008 180/181
2007/0090613 A1 * 4/2007 Lyden ..... A63C 17/02 280/11.221
2007/0273110 A1 * 11/2007 Brunner ..... A63C 17/12 280/11.115
2009/0120705 A1 * 5/2009 McKinzie ..... A63C 17/008 180/181
2012/0285756 A1 11/2012 Treadway
2013/0025955 A1 * 1/2013 Chavand ..... A63C 17/12 180/181
2013/0123665 A1 5/2013 Mariani et al.
2013/0274640 A1 10/2013 Butters et al.
2014/0196757 A1 7/2014 Goffer
2015/0196403 A1 7/2015 Kim et al.
2016/0045385 A1 2/2016 Aguirre-Ollinger et al.
2016/0113831 A1 4/2016 Hollander
2016/0250094 A1 9/2016 Amundson et al.
2016/0331557 A1 11/2016 Tong et al.
2017/0055880 A1 3/2017 Agrawal et al.
2017/0181917 A1 6/2017 Ohta et al.
2017/0182397 A1 * 6/2017 Zhang ..... A63C 17/12
2017/0259811 A1 9/2017 Coulter et al.
2017/0296116 A1 10/2017 McCarthy et al.
2019/0314710 A1 * 10/2019 Zhang ..... A63C 17/04
2019/0351315 A1 * 11/2019 Li ..... A63C 17/08
2020/0061444 A1 * 2/2020 Zhang ..... A63C 17/0006
2020/0061445 A1 2/2020 Zhang et al.
2020/0129843 A1 4/2020 Zhang et al.
2020/0129844 A1 4/2020 Zhang et al.

FOREIGN PATENT DOCUMENTS

CN 201565096 U 9/2010
CN 101912680 A 12/2010
CN 101912681 A 12/2010
CN 102167117 A 8/2011
CN 102805928 A 12/2012
CN 203389316 U 1/2014
CN 104689559 A 6/2015
CN 204364838 U 6/2015
CN 204395401 U 6/2015
CN 105214299 A 1/2016
CN 106039689 A 10/2016
CN 205627021 U 10/2016
CN 106390428 A 2/2017
CN 106390430 A 2/2017
CN 106582003 A 4/2017
EP 0686412 A2 12/1995
EP 0834337 A2 4/1998
EP 0894515 A1 2/1999
EP 3629925 A1 4/2020
JP 2005-81038 A 3/2005
WO 2018082192 A1 5/2018
WO 2018082193 A1 5/2018
WO 2018082194 A1 5/2018
WO 2018082195 A1 5/2018
WO 2019014152 A1 1/2019
WO 2019014154 A1 1/2019
WO 2019212995 A1 11/2019

OTHER PUBLICATIONS

International Search Report and Written Opinion for PCT/CN2017/000499 dated Oct. 20, 2017.
International Search Report and Written Opinion for PCT/CN2017/000502 dated Oct. 13, 2017.
International Search Report and Written Opinion for PCT/US2018/041343 dated Sep. 7, 2018.
International Search Report and Written Opinion for PCT/US2018/041345 dated Sep. 7, 2018.
International Search Report and Written Opinion for PCT/US2019/029742 dated Aug. 26, 2019.
International Search Report and Written Opinion for PCT/CN2017/000500 dated Oct. 20, 2017.

* cited by examiner

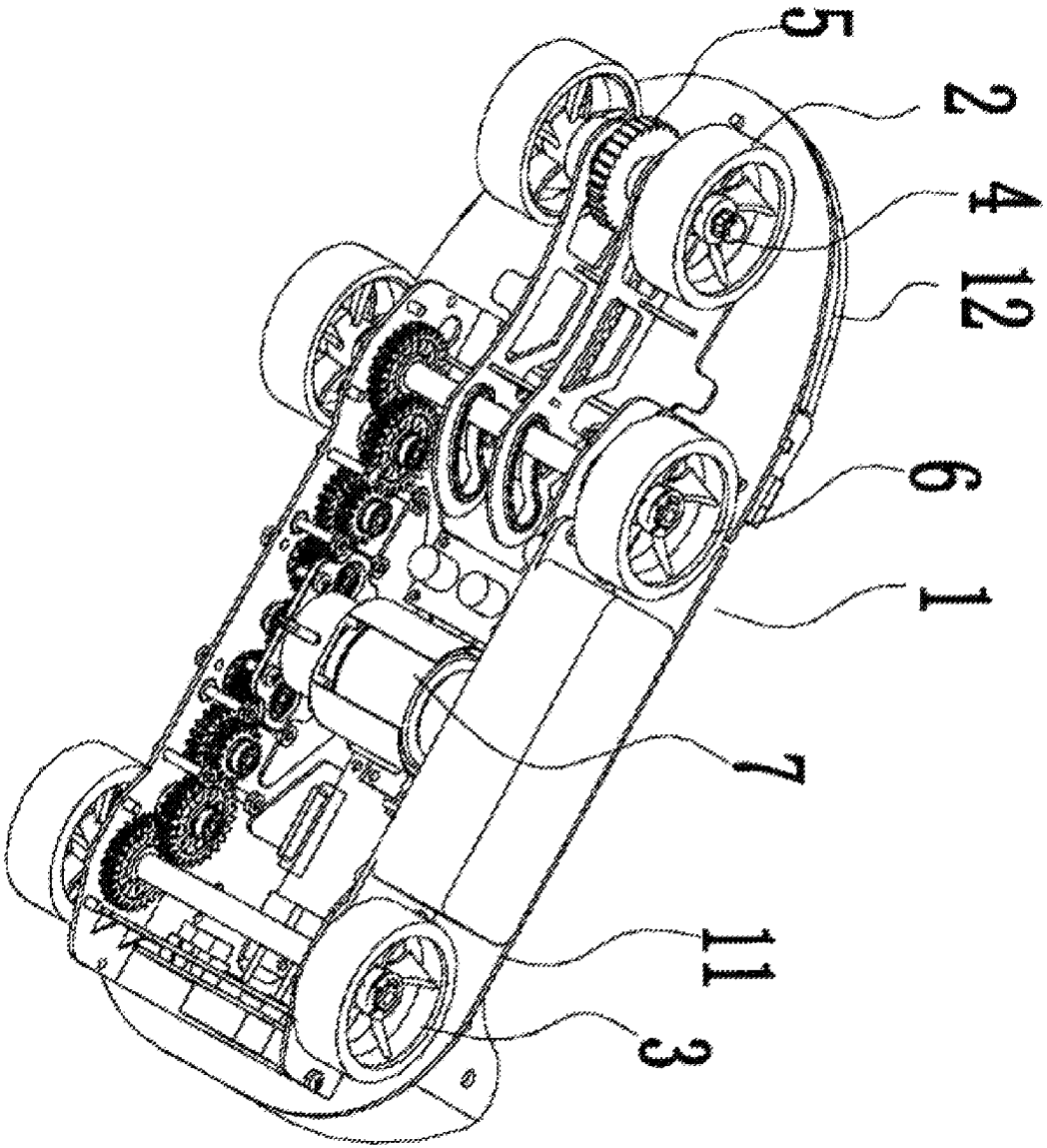
5
2
4
12
6
1
7
11
3

ANTI-REVERSE ROTATION DEVICE OF POWER-DRIVEN SHOE DEVICE

TECHNICAL FIELD

The present application relates to Anti-reverse rotation devices of power shoe devices, and belongs to the technical field of transportation tools.

BACKGROUND ART

With the further growth of the urban population, traffic jam has become the nuisance of every main city. Although public transportation is a very effective solution to the traffic jam, a last kilometer problem, that is, a relatively long final walking distance, still remains, which is one of the factors hindering the building of a perfect bus system. Traditional roller skates can solve the above-mentioned problem to a certain extent, and there are various electric transportation tools on the market, such as electric roller skates appearing recently, which are the solutions to the last kilometer problem.

However, the traditional roller skates and the recent electric roller skates both have one problem that: when lifting up the shoes, people often lift up shoe heels first and then forefoot parts. In this process, front rollers of the shoes are in contact with the ground alone, and shoe bodies would form certain included angles with the ground; at the moment, if the front rollers apply a certain pressure onto the ground, the front rollers would be inverted and make the lifted shoe heels to move backwards, resulting in falling over of people, so that these roller skates are very unsafe to slide on the road.

SUMMARY OF THE INVENTION

In view of the shortcomings in the prior art, the present application provides Anti-reverse rotation devices of power shoe devices, by which, front wheels of the present application would not be inverted, thus achieving an effect of preventing people from falling over.

In order to solve the above-mentioned problem, the present application provides the following technical solution: Anti-reverse rotation devices of power shoe devices, each of which includes a shoe sole. A group of front wheels and a group of rear wheels are disposed on the lower side surface of the shoe sole. Each Anti-reverse rotation device is characterized in that the front wheels are connected with an Anti-reverse rotation mechanism for preventing the front wheels from being inverted. The Anti-reverse rotation mechanisms of the present application can prevent the front wheels from being inverted, so that when the front wheels are in contact with the ground alone, and shoe bodies forms certain included angles with the ground, the phenomenon that people fall over by backward movement of lifted shoe heels if the front wheels apply a certain pressure onto the ground and are inverted is avoided, and the walking safety is improved.

Specifically, the Anti-reverse rotation mechanism includes a rotating shaft connected with the front wheels, a ratchet wheel fixed on the rotating shaft, and a pawl matched with the ratchet wheel.

In order to achieve a better technical effect, a further technical measure also includes that: each of the shoe soles consists of a shoe heel part and a shoe forefoot part. The shoe heel part and the shoe forefoot part are in rotatable connection with each other. The front wheels are mounted on the shoe forefoot part, and a group of middle wheels are further disposed on the shoe heel part. Because the shoe heel parts and the shoe forefoot parts may rotate relatively to accord with the walking posture that a user lifts up heels first and then forefoot parts during walking, the user can keep a normal walking posture during use of the present application. In the normal walking posture, it is easier for people to master the use the present application. Moreover, the present application may be suitable for complicated urban roads, such as switching sidewalks and striding puddles, and its practicability is greatly improved. Furthermore, people can keep at least four rotating wheels on the ground no matter if the shoe heels are on or off the ground during walking, so as to guarantee their stability and improve their walking safety on the road.

A motor is further disposed at the lower part of each of the shoe soles. The output end of the motor is connected with a transmission device which is in driving connection with the middle wheels or the rear wheels. In this solution, by the adoption of the motor for driving, the burden on people during walking can be relieved, and the walking speed is increased.

A motor is further disposed at the lower part of each of the shoe soles. The output end of the motor is connected with a transmission device which is in driving connection with the middle wheels and the rear wheels. In this solution, the motor simultaneously drives the two groups of rotating wheels, namely the middle wheels and the rear wheels, so that when the rear wheels are lifted up, the middle wheels may still provide forward moving power.

Compared with the prior art, the present application has the following beneficial effects that: the Anti-reverse rotation mechanisms of the present application can prevent the front wheels from being inverted, so that when the front wheels are in contact with the ground alone, and the shoe bodies form certain included angles with the ground, the phenomenon that people fall over by backward movement of the lifted shoe heels if the front wheels apply a certain pressure onto the ground and are inverted is avoided, and the walking safety is improved.

BRIEF DESCRIPTION OF THE DRAWINGS

FIG. 1 is a schematic diagram of a structure of Embodiment 1 of the present application.

DETAILED DESCRIPTION OF THE INVENTION

A further detailed description will be made below to the present application in combination with accompanying drawings and specific implementation modes.

Embodiment 1

With reference to FIG. 1, Anti-reverse rotation devices of power shoe devices are provided, each of which includes a shoe sole 1. A group of front wheels 2 and a group of rear wheels 3 are disposed on the lower side surface of the shoe sole 1. Each Anti-reverse rotation device is characterized in that the front wheels 2 are connected with an Anti-reverse rotation mechanism for preventing the front rollers from being inverted.

Wherein, the Anti-reverse rotation mechanism includes a rotating shaft 4 connected with the front wheels 2, a ratchet wheel 5 fixed on the rotating shaft 4, and a pawl matched with the ratchet wheel 5.

The shoe sole 1 consists of a shoe heel part 11 and a shoe forefoot part 12. The shoe heel part 11 and the shoe forefoot part 12 are in rotatable connection with each other. The front wheels 2 are mounted on the shoe forefoot part 12, and a group of middle wheels 6 are further disposed on the shoe heel part 11. A motor 7 is further disposed at the lower part of the shoe sole 1. The output end of the motor 7 is connected with a transmission device which is simultaneously in driving connection with the middle wheels 6 and the rear wheels 3.

Embodiment 2

In this embodiment (FIGURE is omitted), a motor 7 is further disposed at the lower part of the shoe sole 1. The output end of the motor 7 is connected with a transmission device which is in driving connection with the middle wheels 6 or the rear wheels 3.

The rest part is the same as that of Embodiment 1, so that the descriptions thereof are omitted herein.

The invention claimed is:

1. A power shoe device comprising:

a shoe sole comprising a shoe heel part and a shoe forefoot part, wherein a group of front wheels is mounted on the shoe forefoot part, wherein a group of rear wheels is mounted on the shoe heel part, and wherein the group of front wheels and the group of rear wheels are each disposed on the lower side surface of the shoe sole;

wherein the shoe heel part and the shoe forefoot part are in rotatable connection with each other; and wherein the group of front wheels are connected with an anti-reverse rotation mechanism comprising a rotating shaft connected with the group of front wheels, a ratchet wheel fixed on the rotating shaft, and a pawl matched with the ratchet wheel for preventing the group of front wheels from being inverted.

2. The power shoe device according to claim 1, further comprising a group of middle wheels, a motor, and a transmission device, wherein the motor is further disposed at the lower part of the shoe sole; and wherein the output end of the motor is connected with the transmission device which is in driving connection with at least one of the group of middle wheels and the group of rear wheels.

3. The power shoe device according to claim 1, further comprising a group of middle wheels, a motor, and a transmission device, characterized in that the motor is further disposed at the lower part of the shoe sole; and wherein the output end of the motor is connected with the transmission device which is simultaneously in driving connection with the group of middle wheels and the group of rear wheels.

* * * * *